United States Patent [19]

Leonard

[11] Patent Number: 4,787,402

[45] Date of Patent: Nov. 29, 1988

[54] PROCESS AND APPARATUS FOR PROVIDING ROLL RECONSTITUTED TOBACCO MATERIAL

[75] Inventor: Gerard E. Leonard, Kernersville, N.C.

[73] Assignee: R. J. Reynolds Tobacco Company, Winston-Salem, N.C.

[21] Appl. No.: 825,177

[22] Filed: Feb. 3, 1986

[51] Int. Cl.[4] ..... A24B 3/14

[52] U.S. Cl. ..... 131/370; 131/369; 131/353

[58] Field of Search ..... 131/290, 370, 369, 353

[56] References Cited

U.S. PATENT DOCUMENTS

| | | |
|---|---|---|
| 1,068,403 | 7/1913 | Maier . |
| 2,708,175 | 5/1955 | Samfield et al. . |
| 2,734,510 | 2/1956 | Hungerford et al. . |
| 2,845,933 | 8/1958 | Samfield et al. . |
| 3,053,259 | 9/1962 | Parmele et al. . |
| 3,203,432 | 8/1965 | Green et al. . |
| 3,209,763 | 10/1965 | Parmele et al. . |
| 3,821,959 | 7/1974 | Schmidt . |
| 3,865,120 | 2/1975 | Detert et al. . |
| 3,986,515 | 10/1976 | Egri . |
| 4,109,663 | 8/1978 | Maeda et al. . |
| 4,111,211 | 9/1978 | Hincklieff et al. . |
| 4,164,948 | 8/1979 | Beringer et al. . |
| 4,236,538 | 12/1980 | Foster et al. . |
| 4,497,331 | 2/1985 | Nellen . |
| 4,542,755 | 9/1985 | Selke et al. . |

FOREIGN PATENT DOCUMENTS

| | | |
|---|---|---|
| 2159036 | 11/1985 | United Kingdom . |

*Primary Examiner*—V. Millin

*Attorney, Agent, or Firm*—Grover M. Myers

[57] ABSTRACT

The process is carried out using an apparatus including two pressurized roller systems, each roller system having two rollers in roll contact. A series of generally "V" shaped grooves extends about the periphery of one roller of the first roller system, while the other roller thereof has a smooth surface. The two rollers of the second roller system are spaced apart by a distance of about 0.002 inch to about 0.020 inch.

42 Claims, 5 Drawing Sheets

PROCESS AND APPARATUS FOR PROVIDING ROLL RECONSTITUTED TOBACCO MATERIAL

BACKGROUND OF THE INVENTION

This invention relates to methods for making tobacco products, and in particular, to methods for making reconstituted tobacco products under conditions of relatively low moisture levels.

When tobacco leaf is processed for use in smoking products and when tobacco products are manufactured, a substantial amount of scrap or waste tobacco is provided. Scrap or waste tobacco can be in the form of tobacco dust (typical particle size is less than about 60 Tyler mesh), tobacco fines (typical particle size is between about 20 Tyler mesh and about 60 Tyler mesh), tobacco stems, or processed tobacco which remains unused after tobacco product manufacture is interrupted or completed. As scrap or waste tobacco frequently is of high quality, it is highly desirable to reclaim or reconstitute such scrap or waste tobacco. For example, it is desirable to provide reclaimed or reconstituted tobacco in sheet form, and to blend the reclaimed or reconstituted tobacco with tobacco leaf in order to provide cut filler. The resulting cut filler is used in the manufacture of cigarettes.

Various methods for providing reclaimed, reformed, reassembled or reconstituted tobacco are known. For example, tobacco materials can be mixed with relatively large amounts of water, processed, and dried. U.S. Pat. No. 1,068,403 discloses a process for the production of so-called artificial tobacco leaves by which tobacco veins are mixed with water in order to form a pulp, and the pulped veins are further processed. However, the method disclosed in U.S. Pat. No. 1,068,403 requires the use of relatively large amounts of water and undesirable subsequent drying steps.

U.S. Pat. No. 3,053,259, discloses another method for reclaiming tobacco fragments or tobacco fines. For example, tobacco material is ground to a 15 very small size using a hammer mill or ball mill; the ground tobacco is moistened or mixed with a binder; and filamentary shreds are press formed or molded by passing the resulting mixture between a smooth surface roller and a grooved roller. However, the disclosed method requires the use of relatively large amounts of moisture, especially when a binder is not employed.

As there is a need for a process for regenerating tobacco waste products, it would be highly desirable to provide an efficient and effective process for providing reclaimed tobacco in the form of a sheet. In particular, it is desirable to provide reclaimed tobacco using a process which requires neither the use of a relatively large amount of water and post drying of product nor the pre-grinding of tobacco material.

SUMMARY OF THE INVENTION

This invention is a process for providing reclaimed tobacco material in sheet-like form, said process comprising the steps in combination (a) providing tobacco material including tobacco leaf stem material, the tobacco material having a moisture content less than about 30 weight percent, and then (b) passing the tobacco material through the nip of a first pressurized roller system having two rollers exhibiting a nip zone pressure sufficient to provide compression of said tobacco material thereby providing compressed, admixed tobacco material, wherein at least one of the roller faces comprises a series of grooves which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the tobacco leaf stem material is employed in a structural strength providing amount, and then (c) forming under pressure reclaimed tobacco material in sheet-like form by passing the compressed, admixed tobacco material through the nip of a second pressurized roller system having two rollers exhibiting a nip zone pressure sufficient to provide the reclaimed tobacco material, wherein the roller faces of the rollers are positioned in a spaced apart relationship in the region along the rollers where the reclaimed tobacco material is formed, and wherein the spaced apart relationship between the faces of the rollers provides a sufficient distance therebetween to provide formed sheet-like reclaimed tobacco material.

In another aspect, this invention is an apparatus for providing reclaimed tobacco, the apparatus comprising (a) a first pressurized roller system wherein at least one of the roller faces thereof comprises a series of grooves, which series extends longitudinally along the roller wherein each groove extends about the periphery of the roller, and wherein each groove has a maximum width near the surface of the roller and a minimum width near the bottom of the groove, (b) a second pressurized roller system wherein the roller faces of the rollers are positioned in a spaced apart relationship in a region along the rollers, and wherein the spaced apart relationship between the faces of the rollers is a distance which approximates the thickness of sheet-like reclaimed tobacco material.

In another aspect, this invention is a process for providing reclaimed tobacco material in sheet-like form, said process comprising the steps in combination (a) providing tobacco material including tobacco leaf stem material, the tobacco material having a moisture content less than about 30 weight percent, and then (b) passing the tobacco material through the nip of a pressurized roller system having two rollers exhibiting a nip zone pressure sufficient to provide compression of said tobacco material thereby providing said sheet-like material, wherein (i) at least one of the roller faces comprises a series of grooves, which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the tobacco leaf stem material is employed in a structured strength providing amount and (ii) wherein the roller faces of the rollers are in a spaced apart relationship in the region along the rollers where the reclaimed tobacco material is formed and wherein the spaced apart relationship between the faces of the rollers provides a sufficient distance therebetween to provide formed sheet-like reclaimed tobacco material.

In another aspect, this invention is an apparatus for providing reclaimed tobacco, the apparatus comprising (a) a pressurized roller system wherein at least one of the roller faces comprises a series of grooves, which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the roller faces of the rollers are in a spaced apart relationship in a region along the rollers where the reclaimed tobacco material is formed and wherein the spaced apart relationship between the faces of the rollers is a distance which approximates the thickness of sheet-like reclaimed tobacco material.

Surprisingly, the invention allows for the reclamation of tobacco in an efficient and effective manner using a process which requires neither relatively large amounts of moisture nor the necessity of the addition of binders. In fact, the process of this invention can be performed in the absence of binders. However, the process can be performed using binders, humectant, and/or other additives, if desired. The process of this invention can be performed using relatively large pieces of tobacco leaf and leaf stem material, and does not require the pregrinding of said stem material to a small size. The process of this invention can be performed at or near ambient temperatures without the necessity of the application of external heat. If desired, the process of this invention can be performed without chemical pretreatment of the tobacco.

The reclaimed tobacco material in sheet-like form can be employed as is known in the art. For example, the tobacco material provided by the process of this invention can be dried or moistened, cut to the desired size, treated with additives, blended with other tobacco products, etc. The resulting reclaimed tobacco material is most useful in the manufacture of cigarettes. Thus, this invention includes a cigarette containing the reclaimed tobacco material prepared according to the process of this invention.

DETAILED DESCRIPTION OF THE EMBODIMENTS

Figure 1:
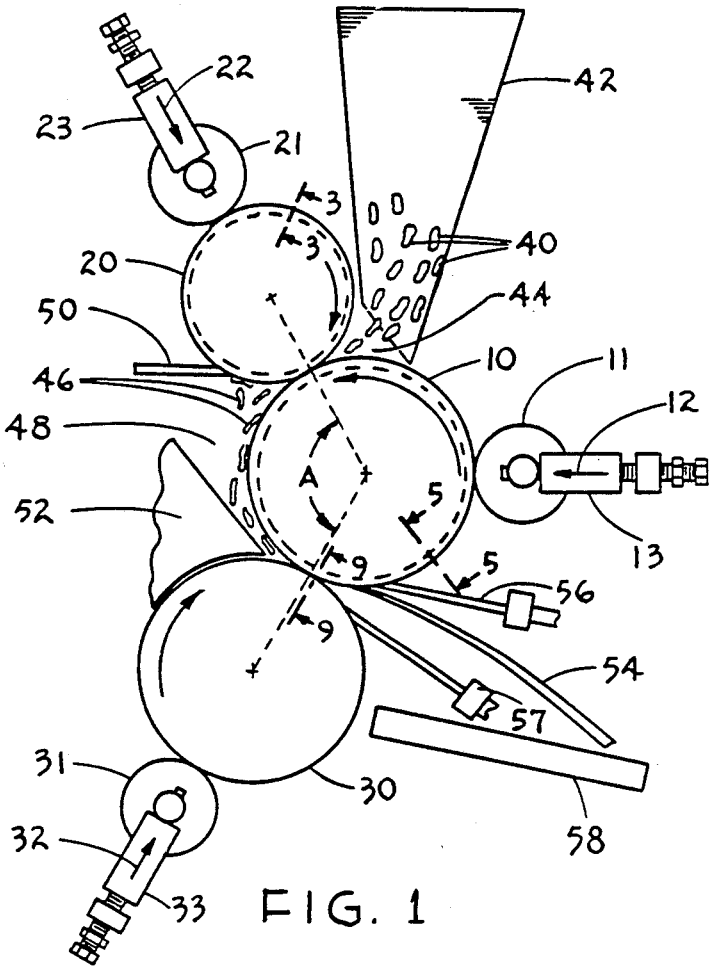
FIG. 1 is a diagrammatic illustration of one embodiment of an apparatus and process of this invention showing the two pressurized roller systems and tobacco material processed to reclaimed sheet-like material.
Figure 2:
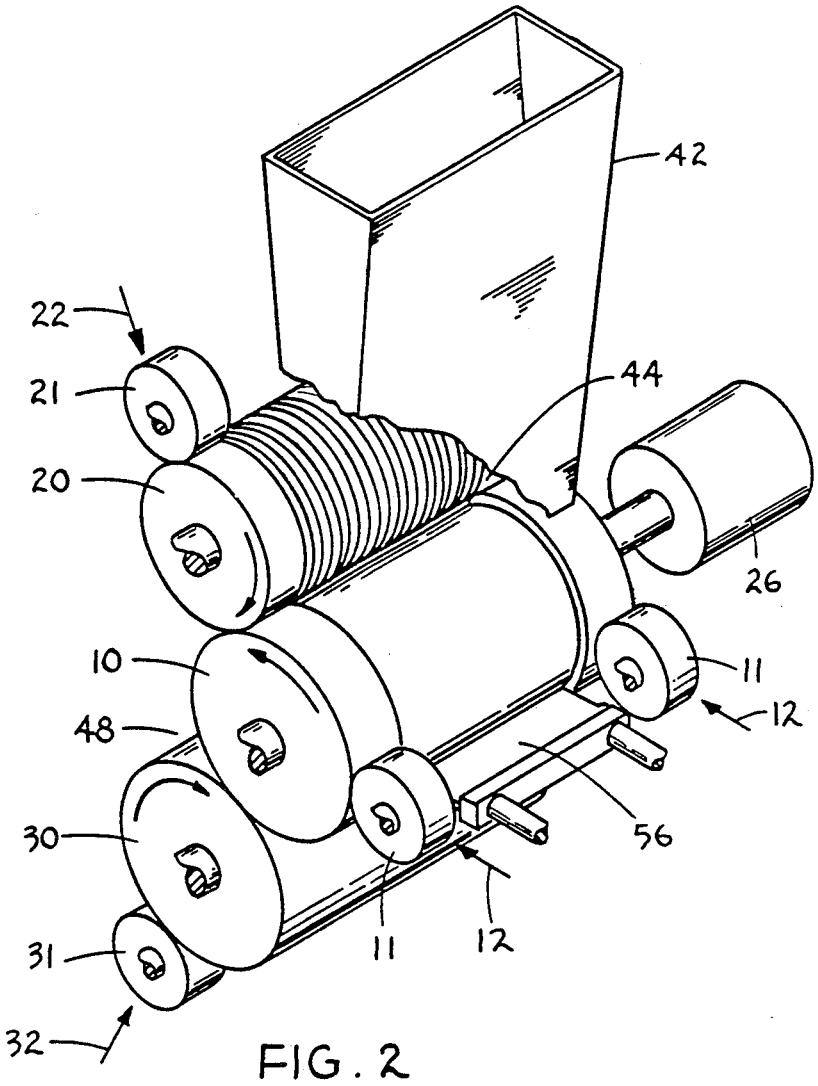
FIG. 2 is a perspective of an apparatus of this invention showing the pressurized roller systems.

FIGS. 1 and 2 illustrate an apparatus for conducting the process of this invention. The apparatus comprises a first pressurized roller system and a second pressurized roller system. As used herein, the term "pressurized roller system" means two rollers in roll contact and exhibiting a nip zone pressure sufficient to provide compression of tobacco material which passes therethrough into a more compressed form. The apparatus includes roller 10 which is a common roller to each of the first and second pressurized roller systems. The first pressurized roller system includes substantially cylindrical roller 10 and another substantially cylindrical roller 20 in roll contact with one another. By the term "roll contact" is meant that two rollers aligned with roll faces essentially parallel to each other have the roll faces thereof in contact with one another for a distance along the length of each roller, and whereby each roller is capable of being rotated about the longitudinal axis of each roller. Each of the rollers forming the first pressurized roller system are mounted such that the aforementioned roll contact of roller 10 with roller 20 is substantially maintained during the process of the invention. Force is applied to each of roller 10 and roller 20 by compression rollers 11 and 21, respectively in roll contact with each of rollers 10 and 20. The force is provided in a direction shown schematically by arrow 12 and arrow 22, respectively. The force can be provided to rollers 11 and 21 by jack screws 13 and 23, respectively. Alternative force providing means can include hydraulic cylinders, or the like. Alternatively, the force providing means can be compression springs, tension springs, or the like. Preferably, two compression rollers are positioned on each roller of the pressurized roller system and are positioned towards the end of the roller with which the compression rollers are in roll contact (as shown in FIG. 2). Typically, each of the two such compression rollers have diameters and a combined longitudinal length less than that of the roller with which the compression rollers are in roll contact. The jack screw is positioned on each compression roller. Each of rollers 10 and 20 are rotated in the direction indicated by the arrows within the rollers. The rollers are rotated in opposite directions relative to one another in order that the tobacco material can be passed through the nip of the rollers. Each of the rollers can be driven using a power source 26 (shown in FIG. 2) such as a variable speed motor (e.g. an electric motor having from about 1 to about 5 horse-power) which turns the rollers by a series of drive gears (not shown). The rollers are supported by support means such as a frame (not shown) to a chassis (not shown).

The second pressurized roller system includes roller 10 and another substantially cylindrical roller 30 in roll contact with one another. Each of the rollers forming the second pressurized roller system are mounted such that the aforementioned roll contact of roller 10 with roller 30 is substantially maintained during the process of this invention. Force is applied to each of roller 10 and 30 by compression rollers 11 and 31 in roll contact with each of rollers 10 and 30, respectively. The force is provided in a direction shown schematically by arrow 12 and arrow 32, respectively. The force can be provided to rollers 11 and 31 by jack screws 13 and 33, respectively. Compression roller 31 and force providing means 33 are positioned as are the compression rollers and force providing means described hereinbefore. Each of rollers 10 and 30 are rotated in the direction indicated by the arrows within the rollers. The rollers are rotated in opposite directions relative to one another in order that the tobacco material can be passed through the nip of the rollers. Each of the rollers can be driven using a power source 26 (shown in FIG. 2) which turns the rollers by a series of drive gears (not shown). The rollers are supported by support means such as a frame (not shown) to a chassis (not shown).

Rollers positioned relative to one another in the configuration shown in FIG. 1 form angle A which can be defined as that angle formed by the roll axis (i.e., the longitudinally extending axis) of each of rollers 20, 10 and 30, respectively. The value of angle A can depend upon a variety of factors including the diameters of the various rollers. Typically, angle A ranges from less than 180° to a limiting angle defined by the diameter of the rollers, and preferably ranges from about 90° to about 150°.

In the preferred embodiment shown in FIGS. 1 and 2, roller 30 has a substantially smooth (i.e., non-grooved) roller face; and roller 20 contains the series of grooves therein. The series extends longitudinally along the roller wherein each groove extends about the periphery of the roller. Roller 10 (which is in roll contact with both of rollers 20 and 30) comprises either a groove extending along the longitudinal axis of the roller and around the periphery of the roller in the region where the sheet-like material ultimately is provided, or a means such as spacer bearings (shown in FIG. 9) positioned at the ends of roller 10 in order to provide the required spaced apart relationship between the roller faces in the region where the sheet-like material ultimately is provided.

When compression rollers are employed at each end of the roller system rollers in order to provide the required nip zone pressures to the roller systems, it is most preferable that the grooved rollers have grooves positioned along the longitudinal length of the roller only in the region between the compression rollers (i.e., the roll ends are not grooved).

The forces between the rollers which typically are required in the process of this invention can vary, but are those forces which are great enough to generate sufficient roller nip zone pressures in order to provide ultimately reclaimed (i.e., reconstituted) tobacco materials in a sheet-like form. That is, sufficient nip zone pressures are those sufficient to provide shearing, mixing, and forming of said tobacco material, and can be as great as is desired. Typically, forces between rollers of at least about 3,000, and as great as about 10,000, preferably about 4,000 to about 6,000 pounds per linear inch, are great enough to generate sufficient roller nip zone pressures. Typically, the rollers are constructed of a metal material such as hardened carbon steel or hardened alloy steel, or other material sufficient to withstand the compression.

The sizes of the various rollers can vary. Typically, roller diameters range from about 3 inches to about 8 inches, preferably about 6 inches to about 8 inches; while roller lengths range from about 4 inches to about 12 inches. Rollers forming the two roller systems can each have diameters which are equal, or the diameters of the various rollers can differ. Rotational roller speeds range, for example, from about 4 rpm to about 30 rpm.

In the process of this invention, tobacco material 40 (shown in FIG. 1) which preferably has been physically premixed using conventional means, is fed by hopper 42 (which is shown as partially cut away in FIG. 2) to feed zone 44 which feeds the tobacco material to the nip of rollers 10 and 20. The tobacco material can vary and typically includes tobacco dust, tobacco fines, scrap tobacco which is recovered from various processing stages and cigarette manufacture stages, scraps and/or sheets of wet formed reconstituted tobacco (for example in dry form), scraps and/or sheets of dry formed reconstituted tobacco, tobacco leaf stems, and tobacco stems and stalks, and the like. Various types of tobaccos and blends thereof can be employed.

The structural strength providing amount of tobacco leaf stem material included in the tobacco material can vary, and depends upon a variety of factors including the amount and size of that leaf stem material which has a length and/or diameter greater than the width and depth of the roller grooves of the first roller system. For example, the amount of leaf stem material is not so high as to provide an undesirable character such as undesirable taste characteristics to the resulting reclaimed material. However, the amount of leaf stem material is at least that amount which is of a size that is capable of providing a desirable structural strength to the reclaimed tobacco material formed according to this invention. For most practical purposes, the amount of leaf stem material required is at least about 15 percent, preferably at least about 18 percent, based on the total weight of tobacco material which is employed. Typically, the amount of leaf stem material does not exceed about 60 percent, based on the total weight of tobacco material which is employed. The tobacco leaf stem material can be employed as is without further grinding, milling, pulping, treating with large amount of water, etc. The character of the tobacco leaf stem material is such that said stem material can provide a structural strength to the resulting reclaimed tobacco material. For example, the stem material can provide a fibrous character to the resulting reclaimed tobacco material. It is believed that the average size of the tobacco leaf stem material is an important factor in providing a reclaimed tobacco material of desirable structural strength. The average size of the tobacco leaf stem material can vary, but the length and/or diameter thereof is larger than the greatest width and depth of the grooves which extend about the periphery of the face of the first pressurized roller system. Typically, the average size of the tobacco leaf stem material which is employed in the process of this invention ranges from about 0.03 inch to about 0.2 inch in diameter, preferably from about 0.04 inch to about 0.13 inch in diameter. Typical tobacco leaf stem material which is employed ranges in length from about 0.25 inch to about 4 inches, preferably from about 0.375 inch to about 2 inches.

The moisture content of the tobacco material which is employed can vary. Typically, a low amount of moisture content requires a relatively greater amount of force between rollers in order to provide reclaimed tobacco materials; while a high moisture content requires the undesirable and energy intensive drying processes attendant in conventional water based reconstituted tobacco processes. Typically, the tobacco material which is employed in the process of this invention exhibits a moisture content of at least about 14 weight percent, preferably at least about 15 weight percent; while the upper limit of the moisture content is less than about 30 weight percent, and typically is as great as about 25 weight percent, preferably as great as about 18 weight percent, based on the dry weight of the tobacco material and moisture. It is believed that moisture imparts a softening of tobacco material as well as providing a material having a pliability sufficiently low to allow for the utilization of a desirable force during the mixing process. It is desirable that the moisture content not be overly high as to cause an undesirable pliability of fiber material thereby preventing adequate intermixing of fibers and resulting in a product having relatively poor tensile strength.

The mixed and pre-formed tobacco material 46 (shown in FIG. 1) which passes through and leaves the first pressurized roller system is fed into zone 48 which is a region capable of feeding the tobacco material to the second roller system. The tobacco material exiting the first roller system can have a tendency to stick to the rollers, and the material can be removed from the rollers (particularly roller 20 as shown in FIG. 1) by scrape 50. Scrape 50 can be a series of needles, a comb-like configuration or a knife-like means such as a doctor blade positioned against the length of the face of the roller so as to remove (i.e., scrape) the tobacco material from the face of the roller. Most preferably, scrape 50 is positioned non-tangentially to the surface of the roller. For example, scrape 50 is positioned against the face of roller 20 at a circumferential location on the surface of the roller within an arc of about 10° to about 45° relative to the point at which rollers 10 and 20 meet in roll contact. Preferably, the scrape is positioned substantially parallel (i.e., within an angle of about 15°) relative to the tangent of the rollers formed by the point of the roll contact of rollers 10 and 20. Scrape 50 is attached to the chassis or frame of the apparatus (not shown) in order to maintain the positioning thereof against the face of the roller.

If desired, zone 48 can be employed as an auxiliary feed zone where tobacco material, particularly small particle size material such as tobacco dust and/or tobacco fines, can be added to the mixed and pre-formed tobacco material 46 exiting the first roller system into zone 48. In particular, the compressed, admixed tobacco material provided by passing the tobacco material through the first pressurized roller system is contacted with tobacco dust and/or tobacco fines, or other such material, in zone 48. Zone 48 can include a slide 52 which is a hopper or other means for directing tobacco material 46 in the second pressurized roller system. The tobacco material 46 in zone 48 which has been mixed and pre-formed under pressure in the first pressurized roller system is generally a macerated, ground or pressed tobacco material having some reconstituted tobacco character.

Tobacco material 46 is further formed under pressure into the desired sheet-like material by passing tobacco material 46 through a subsequent second pressurized roller system. In the preferred embodiment shown in FIGS. 1 and 2, tobacco material 46 is passed through the nip of rollers 10 and 30.

The sheet-like tobacco material 54 exits the second roller system and can be removed from the surface of roller 10 using scrape 56. Scrape 56 is attached to the chassis or frame of the apparatus (not shown) in order to maintain the positioning thereof against the face of roller 10.

Reconstituted tobacco material in sheet-like form can be provided through the assistance of scrape 56 having the form of a doctor blade or other such means positioned against the face of the roller 10 and extending along the face of the roller. Scrape 56 is positioned along that portion of the length of the roller wherein tobacco material tends to stick to the roller. Scrape 56 is most preferably positioned non-tangentially to the roller. For example, for the preferred embodiment illustrated in FIG. 1, scrape 56 is positioned against the face of roller 10 at a circumferential location on the surface of the roller within the arc of about 10° to about 30° relative to the point at which rollers 10 and 30 meet in roll contact and thereby are positioned in a spaced apart relationship. Preferably, the scrape is positioned substantially parallel (i.e., within an angle of about 15°) relative to the tangent of the rollers formed by the roll contact of rollers 10 and 30. Scrape 57 (shown in FIG. 1) provides a means for removing tobacco material from the surface of smooth roller 30. Scrape 57 is a doctor blade or other such means positioned against the face of the roller. Scrape 57 is positioned against the face of roller 30 in much the same manner as scrape 56 is positioned against roller 10. The tobacco material 54 can be directed from the apparatus by collection bin 58 or other removal means, and then collected.

Figure 3:
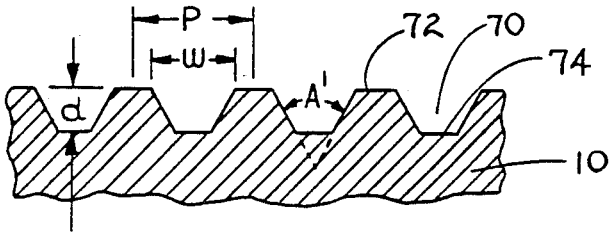
FIG. 3 is an enlarged, partial sectional view of of a roller taken along line 3—3 in FIG. 1 and showing a series of grooves, each groove extending circumferentially about the periphery of the roller.

FIG. 3 illustrates a series of grooves 70 positioned along a roller, and each groove has a top portion 72 (i.e., towards the surface of the roller face) and a bottom portion 74 (i.e., toward the inner portion of the roller). The series of grooves extends longitudinally along roller 20 or a portion thereof. The grooves 70 can be incorporated into roller 20 of the first pressurized roller system by techniques such as machining using a suitable lathe. Each groove completely circumscribes roller 20. Preferably each groove has a shape substantially similar to the other grooves which extend along the roller. The grooves can extend about the roller in a radial fashion, a helical fashion, or the like. Preferably, the grooves each circumscribe the roller substantially transversely relative to the longitudinal axis of the roller. Top portion 72 can be, for example, pointed, or flattened (as illustrated in FIG. 3). When flattened, top portion 72 typically ranges in width from about 0.010 inch to about 0.015 inch. Generally, the flattened top portion 72 is narrow enough so as to not require excessive force in order to maintain roller contact in the pressurized roller system; while flattened top portion 72 is wide enough as to not deform to a substantial extent under typical nip zone pressures. Bottom portion 74 can be pointed, rounded, or flattened (as illustrated in FIG. 3). When flattened, bottom portion 74 typically ranges in width from about 0.003 inch to about 0.007 inch. Generally, bottom portion 74 is narrow enough so as to provide sufficient mixing action of the tobacco material. The mixing action is believed to be provided by the compression feeding performed by the relatively large size leaf stems which carry the tobacco particles into the grooves. Flattened bottom portion 74 is wide enough so as to permit the release of tobacco material from the surface region of the roller after processing. In particular, a bottom portion 74 which is overly narrow or pointed can tend to trap tobacco material in the groove and prevent release of the tobacco material therefrom. The depth d of the groove can vary and typically ranges from about 0.015 inch to about 0.035 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of tobacco material which is processed, the moisture content of said tobacco material, the leaf stem content of the tobacco material, the shape of the groove, and the like. The pitch is defined as that lateral distance from the the center of top portion 72 to the center of the nearest adjacent top portion 72. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 70 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A' of less than about 120°, can mix tobacco material suitably well; and a pressurized roller system having a roller comprising a series of grooves each having a sloping inner edge, each groove circumscribing an angle A' of greater than about 60°, can release processed tobacco material suitably well. The preferred angle A' ranges from about 60° to about 120°, and is most preferably about 90°.

Figure 4:
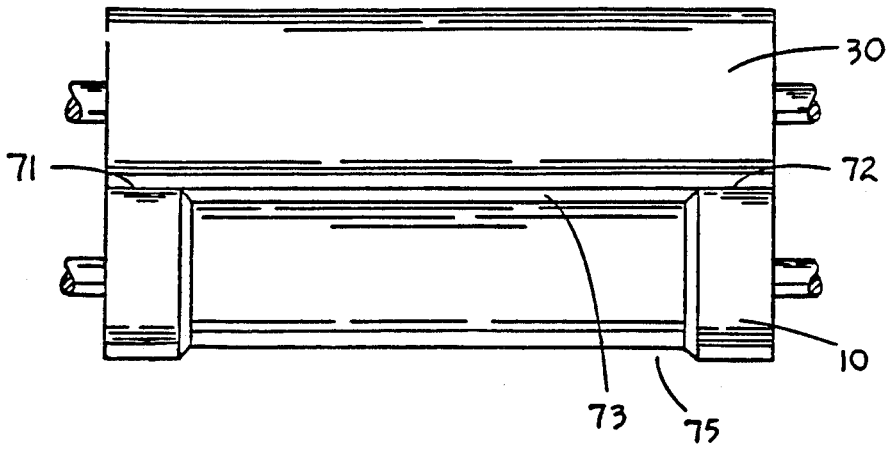
FIG. 4 is an enlarged diagrammatic illustration taken transversely to the longitudinal axis of the rollers and showing the longitudinal lengths of two rollers forming one pressurized roller system illustrated in FIGS. 1 and 2.

FIG. 4 illustrates two rollers of the second pressurized roller system (designated as rollers 10 and 30, respectively) in roll contact with one another towards end region 71 and other end region 72 of each roller. Roller 30 has a substantially smooth surface. The roller faces of each roller are positioned in a spaced apart relationship in region 73 which extends along a portion of the longitudinal length of rollers 10 and 30. The spaced apart relationship and the corresponding region 73 is provided by groove 75 which extends longitudinally along a portion of roller 10 The groove can be incorporated into the roller by techniques such as machining using a suitable lathe. The groove completely circumscribes the roller in the region which the groove extends longitudinally along a portion of the roller. The distance which roller 10 and roller 30 are positioned in a spaced apart relationship can vary and is generally a distance which is capable of providing the sheet-like material of an acceptable thickness. Generally, the distance which roller 10 and roller 30 are positioned in a spaced apart relationship (i.e., the radial distance between the roller face of roller 10 and the roller face of roller 30 as measured in region 73) ranging from about 0.003 inch to about 0.02 inch, with about 0.006 inch preferred.

FIGS. 5, 6, 7 and 8 each illustrate other profiles for roller 10, which roller is capable of being in roll contact with another roller (not shown) at the previously described regions 71 and 72 toward each end of roller 10. Roller 10 comprises groove 75 which extends longitudinally therealong and completely circumscribes the roller in the region which the groove extends longitudinally along the portion of the roller. Typically, a groove 75 can extend from about 10 to about 90 percent of the longitudinal length of roller. Each of FIGS. 5, 6, 7 and 8 illustrate various aspects by which groove 75 of roller 10 can be formed.

Figure 5:
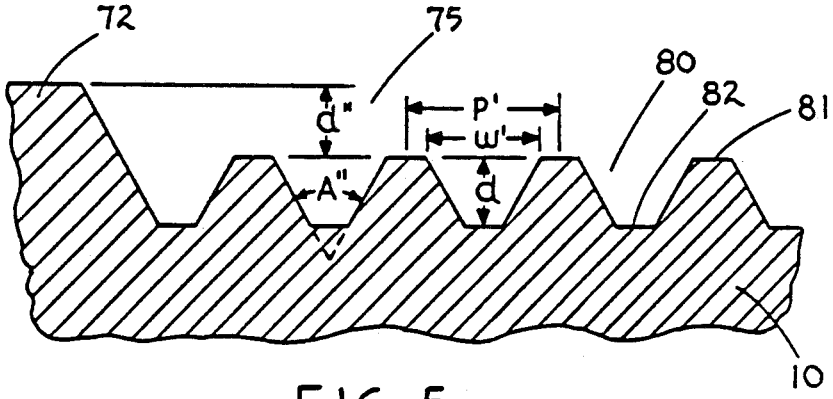
FIG. 5 is an enlarged, partial sectional view of one embodiment of a roller taken along line 5—5 in FIG. 1 showing the depressed groove extending longitudinally along the roll face of the roller and therewithin a series of grooves, each groove extending circumferentially about the periphery of the roller.

In FIG. 5, a series of grooves 80 are positioned along roller 10 within groove 75. Each groove 80 has a top portion 81 (i.e., towards the surface of the roller face) and a bottom portion 82 (i.e., toward the inner portion of the roller) within groove 75. The grooves can be incorporated into the roller by techniques such as machining using a suitable lathe. Each groove 80 completely circumscribes the roller. Preferably each groove 80 has a shape substantially similar to the other such grooves which extend along the roller. The grooves can extend about the roller in a radial fashion, a helical fashion, or the like. Preferably, the grooves circumscribe the roller substantially transversely relative to the longitudinal axis of the roller. Top portion 81 can be, for example, pointed, or flattened (as illustrated in FIG. 5). When flattened, top portion 81 typically ranges in width from about 0.008 inch to about 0.015 inch. Bottom portion 82 can be pointed, rounded, or flattened (as illustrated in FIG. 5). When flattened, bottom portion 82 typically ranges in width from about 0.003 inch to about 0.007 inch. Generally, bottom portion 82 is narrow enough so as to provide further mixing action of the tobacco material. The mixing action is believed to be provided by the compression feeding performed by the relatively large size leaf stems which carry the tobacco particles into the grooves. Flattened bottom portion 82 is wide enough so as to permit the release of tobacco material from the surface region of the roller after processing. In particular, a bottom portion 82 which is overly narrow or pointed can tend to trap tobacco material in the groove and prevent release of the tobacco material therefrom. The depth d' of each groove 80 can vary and typically ranges from about 0.010 inch to about 0.030 inch. The depth is defined as the radial distance between bottom portion 82 of groove 80 and the top portion 81 of groove 80. The greatest width w' of groove 80 can vary and typically ranges from about 0.015 inch to about 0.040 inch. The width is defined as the lateral distance measured across the groove. The pitch p' of the groove can vary and depends upon a variety of factors including the type of tobacco material which is processed, the moisture content of said tobacco material, the leaf stem content of the tobacco material, the shape of the groove, and the like. The pitch is defined as that lateral distance from the the center of top portion 81 to the center of the nearest adjacent top portion 81. Typically, a pitch of about 0.02 inch (i.e., about 1/50 inch) to about 0.06 inch (i.e., about 1/16 inch); preferably about 0.03 inch (i.e., about 1/32 inch) is useful for most applications. The shape of groove 80 can vary and depends upon a variety of factors. However, each groove has a maximum width near the surface of groove 80 and a minimum width near the bottom of groove 80. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A" of greater than about 60°, can mix tobacco material suitably well; and a pressurized roller system having a roller comprising a series of grooves each having a sloping inner edge, each groove circumscribing an angle A" of greater than about 60°, can release processed tobacco material suitably well. The preferred angle A" ranges from about 60° to about 120°, and is most preferably about 90°. The depressed depth d" of groove 75 is that radial distance measured from the outermost surface of the roller face at region 71 to the top portion 81 of groove 80. In particular, the outermost surface of top portion 81 of each groove 80 does not extend as far outward from the center of roller 10 (as measured from the longitudinal axis of the roller) as does the outermost surface of the roller face at region 71. Typically, depressed depth d" of groove 75 varies for a particular tobacco material depending upon factors such as the moisture content of the tobacco material, the composition of the tobacco material, etc. Generally, depressed depth d" ranges from about 0.003 inch to about 0.012 inch, with about 0.006 inch being preferred.

Figure 6:
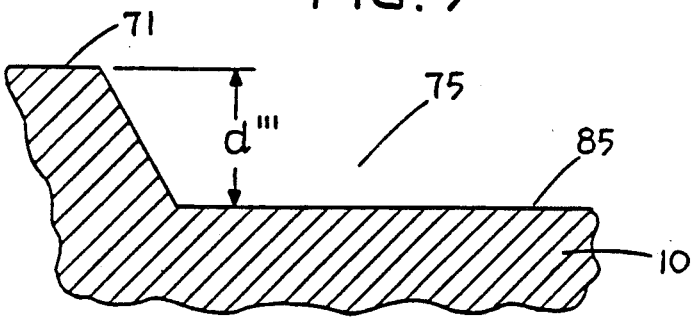
FIG. 6 is an enlarged, partial sectional view of one embodiment of a roller taken along line 5—5 in FIG. 1 showing the depressed groove extending longitudinally along the roll face of the roller.

In FIG. 6, roller 10 has groove 75 extending longitudinally therealong. Groove 75 has a substantially smooth surface 85. The depressed depth d" of groove 75 is that radial distance measured from the outermost surface of the roller face at region 71 to surface 85 of the groove. Typically, the depressed depth of the groove is that depth which provides a reclaimed sheet-like tobacco material. Factors such as the tobacco material composition, moisture content of the composition, the presence or absence of binders, forces between rollers, etc., will dictate the depressed depth of the groove. Typically, the depressed depth d''' for the embodiment shown in FIG. 6 ranges from about 0.004 inch to about 0.012 inch.

Figure 7:
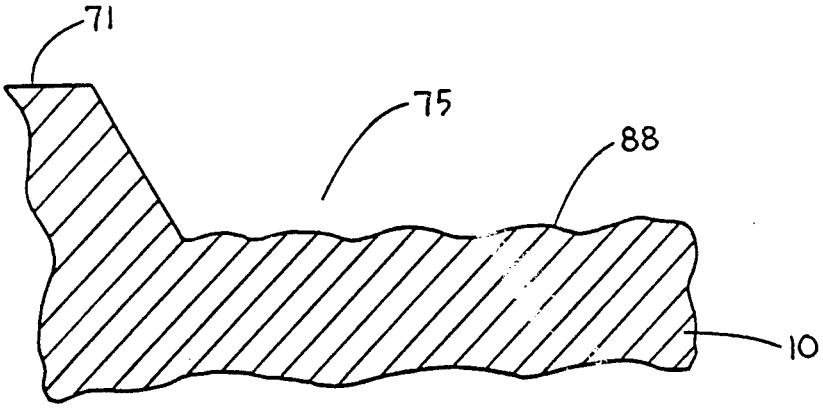
FIG. 7 is an enlarged, partial sectional view of one embodiment of a roller taken along line 5—5 in FIG. 1 and showing the depressed groove extending longitudinally along the roll face of the roller and therewithin an uneven groove surface.

In FIG. 7, roller 10 has groove 75 extending longitudinally therealong. Groove 75 has a further recessed or uneven surface 88 which can exhibit a variety of cross sectional shapes such as sinusoidal, V-shaped, U-shaped, etc. The average depressed depth of groove 75 of this embodiment can vary and depends upon factors such as those disclosed hereinbefore the other such embodiments and is the radial distance measured from the outermost surface of the roller face at region 71 to surface 88 of the groove. The particular shape of surface 88 generally is selected in order to provide the desired surface properties to the sheet-like material which is provided.

Figure 8:
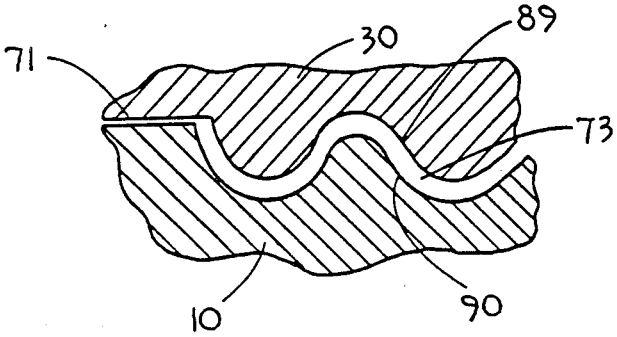
FIG. 8 is an enlarged, partial sectional view of one embodiment of two rollers forming the second pressurized roller system shown along the line of roll contact of the rollers and taken along line 8—8 in FIG. 1.

In FIG. 8, rollers 10 and 30 each are positioned in a spaced apart relationship in region 73 which extends along a portion of each roller. Each of rollers 10 and 30 are in roll contact in region 71; and surface 89 of roller 30 and surface 90 of roller 10 each form a somewhat sinusoidal shape longitudinally along end roller. The spaced apart relationship between the rollers, or the depressed depth of the somewhat sinusoidal shaped groove can vary, and generally ranges from about 0.004 inch to about 0.012 inch, with about 0.006 inch being preferred. The resulting sheet-like material having a wavy or corrugated-type profile can be employed in providing cut filler having an improved filling capacity.

Figure 9:
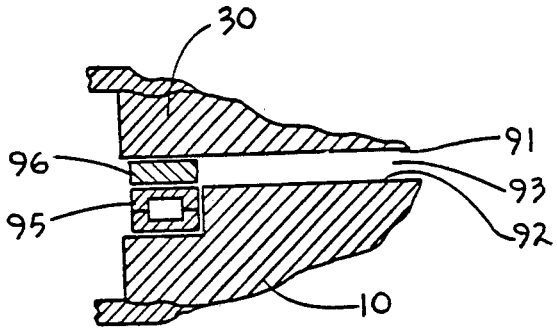
FIG. 9 is an enlarged, partial sectional view of one embodiment of two rollers forming one pressured roller system taken along line 9—9 in FIG. 1 and showing an embodiment including spacer bearings and a differential speed roller arrangement which provide a spaced apart relationship therebetween.

In FIG. 9 roller face 91 of roller 30 and roller face 92 roller 10 are positioned in a spaced apart relationship in region 93 along the longitudinal axis of each roller. The spaced apart relationship of the rollers is provided by idler bearings 95 which encircle each end of roller 10 and spacer ring 96 which encircles and is mounted to each idler bearing, or other such means. Machining of each end of the roller can be performed as required in order to provide the desired fit of idler bearing assembly and spacer ring. Roll contact is provided between the roll face of roller 30 and either a surface of the idler bearing assembly or the spacer ring encircling roller 10. The surface of the idler bearing assembly and encircling spacer ring extend longitudinally along a portion of that roller. Roller face 92 of roller 10 can be grooved, roughed, or smooth (as shown in FIG. 9). The spaced apart relationship of the rollers is a distance which approximates the thickness of sheet-like reclaimed tobacco material, and generally the distance ranges from about 0.003 inch to about 0.007 inch, with about 0.004 inch being preferred. Of particular interest is the fact that for this embodiment the drive gears (not shown) which turn rollers 10 and 30 can be arranged in order that there is a linear speed differential between the roller surfaces of each of rollers 10 and 30. The linear speed differential between rotating rollers 10 and 30 will depend upon factors such as the character of the tobacco material being processed, the roller diameters, etc. Typically, linear speed differentials range from greater than 0 inches per minute, preferably greater than about 30 inches per minute, up to about 120 inches per minute, preferably up to about 60 inches per minute, for a pair of 4 inch diameter rollers. It is believed that an additional shearing action can be created between the rollers rotating at different linear speeds that is capable of aligning more of the individual tobacco fibers, thereby providing the capability of producing a homogeneous and strong sheet.

Figure 10:
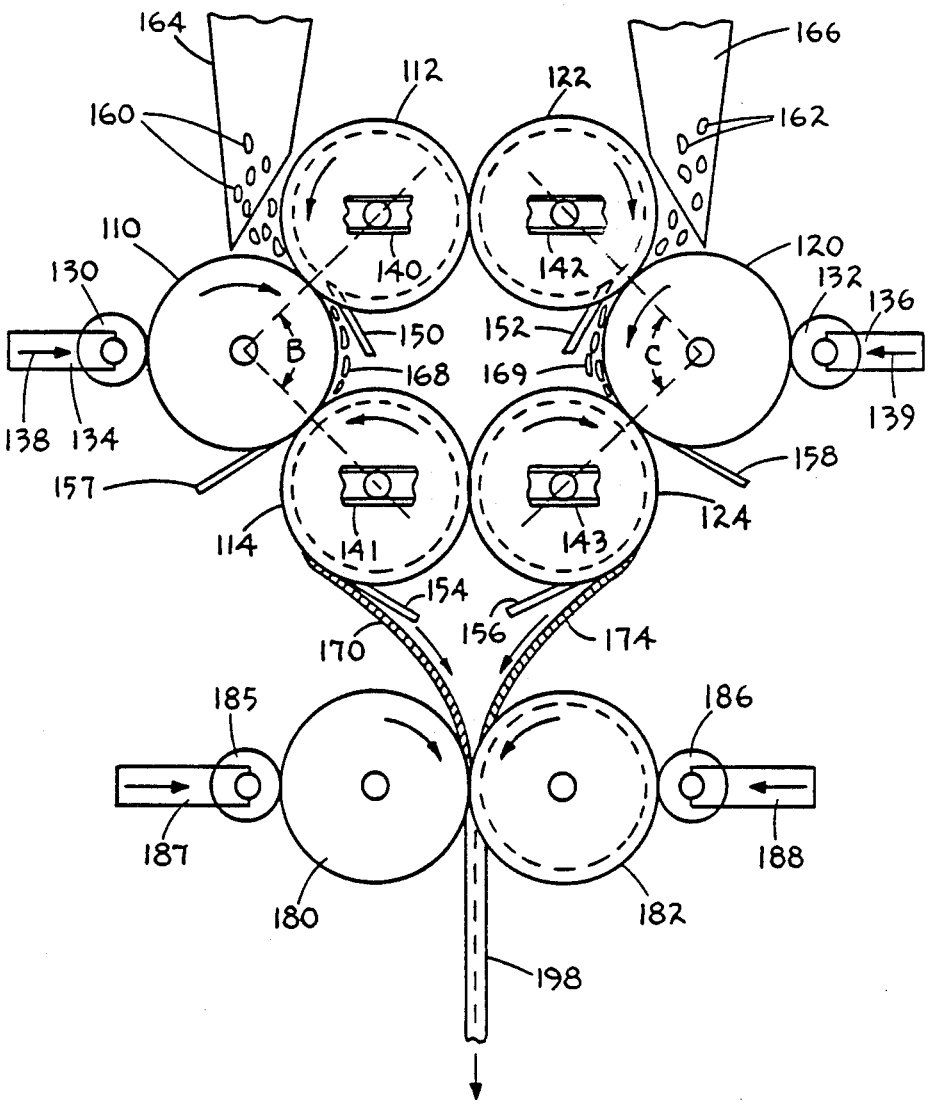
FIG. 10 is a diagrammatic illustration of one embodiment of an apparatus and process of this invention showing the pressurized roller systems and the tobacco material processed to reclaimed sheet-like material.

FIG. 10 illustrates another apparatus for conducting the process of this invention. The apparatus comprises first pressurized roller system and another first pressurized roller system; and second pressurized roller system and another second pressurized roller system. The apparatus includes roller 110 which is in roll contact with each of roller 112 (thus forming the first roller system) and roller 114 (this forming the second pressurized roller system). In addition, roller 120 is in roll contact with each of roller 122 (thus forming the other first roller system) and roller 124 (thus forming the other second pressurized roller system). The size, shape and composition of the rollers are similar to that of those rollers described for the embodiment described hereinbefore. Each of rollers 112 and 122 are in roll contact with one another, and preferably each roller has a series of grooves in the longitudinally extending roller face thereof. Each of rollers 112 and 122 are generally as described by FIG. 3. Each of rollers 114 and 124 are in roll contact with one another; and preferably each roller has either a groove extending along the longitudinal axis of the roller and around the periphery of the roller in the region where the sheet-like material ultimately is provided, or a means such as spacer bearings positioned at the ends thereof in order to provide the necessary spaced apart relationship between substantially smooth roller faced rollers 110 and 120, respectively. Roller 114 and 124 are generally as described in FIGS. 4, 5, 6, 7, 8 and 9. Rollers 112, 110 and 114, and rollers 122, 120 and 124 each form angle B and angle C, respectively, formed by the roll axis of each of the respective rollers. Angles B and C are less than 180°, and preferably range from about 90° to about 150°. Force is applied to each of rollers 110 and 120. For example, rollers 110 and 120 can be in roll contact with compression rollers 130 and 132, respectively. Each of compression rollers 130 and 132 are equipped with jack screws 134 and 136, respectively. The force is applied to each of rollers 110 and 120 indicated by arrows 138 and 139, respectively. Each of rollers 112, 114, 122 and 124 are mounted on horizontally extending restraints 140, 141, 142 and 143, respectively. The restraints (which are shown as partially cut away) allow the respective rollers to be mounted such that each of rollers 112 and 122, and rollers 114 and 124 can be in roll contact with one another. The restraints allow the respective rollers to be maintained in roll contact under the conditions necessary to provide the respective pressurized roller systems. The restraints can be metal tracks upon which the rollers are mounted, and can be supported by a frame or chassis (not shown). Forces between rollers are similar to those forces for the embodiment described hereinbefore. Rollers 112 and 122 of the first pressurized roller systems each have scrapes 150 and 152, respectively positioned thereagainst. Scrapes 150 and 152 and the positioning thereof are similar to the corresponding scrape described for the previously described embodiment. Rollers 114 and 124 of the second pressurized roller systems each have scrapes 154 and 156, respectively positioned thereagainst. Scrapes 154 and 156 and the positioning thereof are similar to the corresponding scrape described for the previously described embodiment. Rollers 110 and 120 can have scrapes 157 and 158, respectively, positioned against the roll faces thereof. Scrapes 157 and 158 can be doctor blades or other such means for cleaning the surface of the rollers of tobacco material.

In the process of using the apparatus described in FIG. 10, tobacco material 160 and 162 is contained in hoppers 164 and 166, respectively. Tobacco material 160 passes through the nip zone of rollers 110 and 112 which are rotated in opposite directions such that the tobacco material passes therethrough. The compressed, admixed tobacco material 168 then passes through the nip of rollers 110 and 114 which are rotating in opposite directions. Sheet-like material 170 is formed thereby. Similarly, tobacco material 162 passes through the nip zone of rollers 120 and 122 which are rotating in opposite directions. The compressed, admixed tobacco material 169 then passes through the nip of rollers 120 and 124 which are rotating in opposite directions. Sheet-like material 174 is formed thereby. Each of sheet-like materials 170 and 174 are passed through the nip of a latter pressurized roller system including rollers 180 and 182 which are in roll contact with one another. Roller 180 has a substantially smooth surface and roller 182 has a recessed groove or other such means such that a region of spaced apart relationship is provided between the roller faces. The spaced apart relationship ranges from about 0.008 inch to about 0.03 inch. The rollers are rotated in opposite directions such that the reclaimed tobacco material passes through the nip thereof. High nip zone pressures (i.e., in excess of about 3,000 pounds per linear inch) are maintained between rollers 180 and 182 force providing means such as compression rollers 185 and 186, respectively which are in roll contact therewith and are equipped with jack screws 187 and 188, respectively. Sheet-like reclaimed tobacco material 198 is provided as product. Each of the rollers of the pressurized roller systems can be driven by a power source (not shown) by a series of drive gears (not shown). The rollers are supported by support means such as a frame (not shown) to a chassis (not shown).

The process of this invention employs first and second roller systems described previously. It is believed that the shearing action provided by each pressurized roller system provides a breakdown of individual particles and fibers of tobacco material. Such a breakdown of particles and fibers is believed to provide a separation of some of the natural binding materials from the particles and fibers, which natural binding materials can provide a binding action to the tobacco material in order to provide a resulting sheet-like material. In addition, it is believed that shearing and mixing action provided by the pressurized roller system can provide a sufficient mechanical interlocking of fibers and particles, thus forming a type of matrix. Thus, a first pressurized roller system containing a roller having a series of grooves having a size smaller than that of the tobacco leaf stem material is believed to provide a separation of leaf stem material, mixing and remixing of tobacco material, coalescing and agglomeration of tobacco material, and binding of tobacco material with natural binding materials of tobacco material.

The reclaimed tobacco which is provided according to the process of this invention can be provided generally in the form of a sheet. The sheet-like material exhibits good flexibility and tensile strength. Typically, the tobacco material in the form of a sheet exhibits a structural strength which approaches that of tobacco leaf. By the term "sheet" as used herein is meant that the tobacco material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet can range from about 0.005 inch to about 0.040 inch, preferably from about 0.010 inch to about 0.020 inch. The length and width of the sheet or strip of reconstituted tobacco material can vary. The width of the sheet generally is determined by factors such as the longitudinal distance which the rollers of the second pressurized roller system are in a spaced apart relationship, the length of the means for removing the reclaimed tobacco material from the roller face of the roller of the second roller system, and the like. The sheet-like material exhibits good flexibility and tensile strength. The sheet can be cut as are tobacco leaf or wet formed reconstituted tobacco material (e.g., in strips of about 32 cuts per inch) and employed as cut filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

An apparatus which is generally described in FIGS. 1 and 5 is provided, except that rollers 20 and 30 each have a substantially smooth surface. The rollers are substantially cylindrical, constructed of hardened carbon steel, and have a diameter of 4 inches and a roller face having a length of 4 inches. Roller 10 is generally described in FIG. 5. Roller 10 comprises groove 75 which extends 2 inches longitudinally along the roller, and the 1 inch distance along the roller face at each end of the roller is relatively smooth. The face of the roller within groove 75 comprises a series of grooves extending in a radial fashion about the periphery of the roller within groove 75. The depressed depth d″ of groove 75 is 0.010 inch, and the depth d′ of each groove 80 is 0.009 inch. The pitch p′ of each groove 80 is 0.03125 inch, and the angle A′ is about 90°. The top portion 81 of each groove 80 is 0.003 inch, and the bottom portion 82 of each groove 80 is flattened by a distance of 0.003 inch. Rollers 20, 10 and 30 are operated using a variable speed drive using a variable speed drive using a variable speed 1 horsepower electric motor at a speed of 16 rpm, and nip zone pressures between each of rollers 10 and 30, and rollers 10 and 20 of 3000 pounds per linear inch are generated. The angle A provided by the central axis of roller 20, roller 10 and roller 30, respectively, is 150°. Scrape 56 in the form of a comb is positioned so as to remove the reclaimed tobacco material from roller 10. Force is provided to each of rollers 10, 20 and 30 by two compression rollers positioned in roll contact with each of rollers 10, 20, and 30. Each compression roller is positioned at one end of each of rollers 10, 20 and 30. The compression rollers are about 1 inch in longitudinal length and about 2 inches in diameter. Force is provided to the compression rollers by jack screws.

A blend of scrap tobacco is provided. The blend is about 45 percent cut tobacco filler fines having an average particle diameter of less than 20 Tyler mesh, about 17 percent tobacco dust from a Molins MK9 Maker, and about 38 percent Winnower throw stems from a Molins MK9 Maker. The blend exhibits a moisture content of about 10 percent. A resultant blend is provided by contacting the blend with enough water to provide a blend exhibiting a 17 percent moisture level. The resultant blend is introduced into the apparatus and a reclaimed tobacco material in the form of sheet-like tobacco material having dimensions of inches wide and 0.04 inch thick is provided. The resulting sheet-like material is similar in character to wet reconstituted tobacco product, and exhibits a flexibility and tensile strength sufficient to allow for cutting thereof into strips of 32 cuts per inch without significant breakage thereof.

EXAMPLE 2

To the blend of scrap tobacco described in Example 1 is added broken, dried pieces (originally about 0.025 inch thick by about 4 inches in length and width) of wet formed reconstituted tobacco material product. To the tobacco material mixture is added water. The resultant blend comprises 15 percent of the wet formed reconstituted tobacco material and a 25 percent moisture level. The resultant blend is processed using the apparatus described in Example 1, except that the depressed depth d″ of groove 75 is 0.007 inch rather than 0.015 inch. The resulting sheet-like reconstituted tobacco material is strong and pliable.

EXAMPLE 3

To the blend of scrap tobacco described in Example 1 is added enough guar gum, glycerine and water to provide a resultant blend comprising 10 percent binder, 5 percent humectant and a 20 percent moisture level. The resultant blend is processed using an apparatus generally described in Example 1. Roller 30 has a substantially smooth surface. Roller 10 has a series of grooves therein as shown in FIG. 3. Roller 10 has grooves extending about 2 inches along the roller face, and the 1 inch distance along the roller face of each end of the roller is relatively smooth. A cross section of roller 10 is generally described in FIG. 3. Roller 10 has a groove depth d of 0.009 inch, pitch p of 0.03125 inch, a flattened top portion 72 of 0.008 inch, and a flattened bottom portion 74 of 0.003 inch. Roller 20 is equipped at each end thereof with an idler bearing assembly and spacer ring generally as described in FIG. 9. Each idler bearing assembly and spacer ring extends about 1 inch along the longitudinal length of roller 20. The idler bearing assembly and circumscribing spacer ring provides a spaced apart relationship of 0.003 inch between the roller faces of rollers 10 and 20 in the 2 inch region along the grooved roller face of roller 10. Roller 20 is rotated at a linear differential speed of from 33.7 inches per minute to 118.8 inches per minute greater than that of the roller 10 surface during the processing of the resultant blend. The resulting pliable sheet-like tobacco material having dimensions of 2 inches wide and 0.01 inch thick is provided by passing the tobacco material between the nip of rollers 10 and 20. The sheet-like material is provided in region 48 as the material is removed from roller 10 by scrape 50.

EXAMPLE 4

A blend of scrap tobacco was provided by contacting 114 grams Winnower throw stems from a Molins MK9 Maker, 50 grams tobacco dust from a Molins MK9 Maker and 136 grams cut filler fines having an average particle diameter of less than 20 Tyler mesh. The blend exhibits a moisture content of about 10 percent. The blend is contacted with enough water (about 56 grams) to provide a blend exhibiting 25 percent moisture level which is lowered to 20 percent moisture level after the blend is allowed to set overnight. The resultant blend is designated as Resultant Blend A.

A blend of scrap tobacco is provided by contacting 75 grams of broken scraps of dried wet reconstituted tobacco (originally about 0.25 inch to about 4 inches in size), 50 grams of tobacco dust from a Molins MK9 Maker and enough water (about 23 grams) to provide a blend exhibiting about 25 percent moisture level which is lowered to about 20 percent moisture level after the blend is allowed to set overnight. The resultant blend is designated as Resultant Blend B.

An apparatus generally described in FIG. 1 and Example 1 is provided. Roller 20 has a diameter of 3 inches and has grooves extending about 2 inches along the roller face, and the 1 inch distance along the roller face at each end of the roller is relatively smooth. A cross section of roller 20 is generally described in FIG. 3. Roller 20 has a groove depth d of 0.009 inch, pitch p of 0.03125 inch, a flattened top portion 72 of 0.008 inch and a flattened bottom portion 74 of 0.003 inch. Rollers 10 and 30 each have a diameter of 4 inches and have substantially smooth surfaces. Roller 10 is equipped at each end thereof with an idler bearing assembly and spacer ring generally as described in FIG. 9. Each idler bearing assembly and spacer ring extends about 1 inch along the longitudinal length of roller 10. The idler bearing assembly and spacer ring provides a spaced apart relationship of 0.005 inch between the roller faces of rollers 10 and 30, and rollers 10 and 20, in the 2 inch region along the roller faces. Roller 10 is rotated at a rotational speed of 8 rpm. The speed of rotating roller 10 relative to roller 20 is 16/9; and the speed of rotating roller 10 relative to roller 30 is 4/3.

Resultant Blend A is fed into the apparatus at feed zone 44 by way of hopper 42. Resultant Blend B is fed into the apparatus a feed zone 48. The resulting sheet-like tobacco material 54 which exhibits the second pressurized roller system is pliable, is similar in character to wet reconstituted tobacco product, and exhibits good tear strength.

EXAMPLE 5

The sheet-like tobacco material provided in Example 4 is further processed using the apparatus described in Example 4. In particular, the sheet-like product is fed randomly through the apparatus a second time by way of hopper 42. The resulting sheet-like tobacco material which is provided by the further processing exhibits good tear strength and pliability.

What is claimed is:

1. A process for providing reclaimed tobacco material in sheet-like form, said process comprising the steps in combination (a) providing tobacco material including tobacco leaf stem material, the tobacco material having a moisture content less than about 30 weight percent, and then (b) passing the tobacco material through the nip of a first pressurized roller system having two rollers exhibiting a nip zone pressure sufficient to provide compression of said tobacco material thereby providing compressed, admixed tobacco material, wherein at least one of the roller faces comprises a series of grooves, which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the tobacco leaf stem material is employed in a structural strength providing amount, and then (c) forming under pressure reclaimed tobacco material in sheet-like form by passing the compressed, admixed tobacco material through the nip of a second pressurized roller system having two rollers exhibiting a nip zone pressure sufficient to provide the reclaimed tobacco material, wherein the roller faces of the rollers are positioned in a spaced apart relationship in the region along the rollers where the reclaimed tobacco material is formed, and wherein the spaced apart relationship between the faces of the rollers provides a sufficient distance therebetween to provide formed sheet-like reclaimed tobacco material.

2. The process claim 1 wherein said of tobacco material is provided in the absence of a binder.

3. The process of claim 1 wherein the amount of said tobacco leaf stem material in said tobacco material is at least about 15 percent, based on the total weight of said tobacco material.

4. The process of claim 1 wherein each of said nip zone pressures is at least about 3,000 pounds per linear inch.

5. The process of claim 1 wherein said tobacco material which is provided in step (a) includes scraps and/or sheets of wet formed reconstituted tobacco.

6. The process of claim 1 wherein the tobacco material exhibits a moisture content between about 15 weight percent and about 18 weight percent.

7. The process of claim 1 wherein the tobacco material exhibits a moisture content between about 14 weight percent and about 25 weight percent.

8. The process of claim 1 wherein the amount of said structural strength providing amount of leaf stem material ranges from about 15 to about 18 percent based on the total weight of tobacco material which is employed.

9. The process of claim 8 wherein said structural strength providing amount of tobacco leaf stem material ranges from about 0.03 inch to about 0.2 inch in diameter, and from about 0.25 inch to about 4 inches in length.

10. The process of claim 1 wherein said tobacco leaf stem material is not pre-ground.

11. The process of claim 1 wherein each of said grooves is generally "V" shaped.

12. The process of claim 1 wherein the compressed admixed tobacco material provided by passing the tobacco material through the first pressurized roller system is contacted with tobacco dust and/or tobacco fines prior to passing the compressed, admixed material through the second pressurized roller system.

13. The process of claim 1 wherein each of said grooves circumscribe the roller substantially transversely relative to the longitudinal axis of the roller.

14. An apparatus for providing reclaimed tobacco, the apparatus comprising (a) a first pressurized roller system wherein at least one of the roller faces thereof comprises a series of grooves, said series extending longitudinally along the roller wherein each groove extends about the periphery of the roller, and wherein each groove has a maximum width near the surface of the roller and a minimum width near the bottom of the groove, (b) a second pressurized roller system wherein the roller faces of the rollers are positioned in a spaced apart relationship in a region along the rollers, and wherein the spaced apart relationship between the faces of the rollers is a distance which approximates the thickness of sheet-like reclaimed tobacco material.

15. The apparatus of claim 14 wherein each groove has a depth which ranges from about 0.015 inch to about 0.035 inch.

16. The apparatus of claim 14 wherein each groove has a greatest width which ranges from about 0.015 inch to about 0.040 inch.

17. The apparatus of claim 14 wherein each groove has a flattened or rounded bottom.

18. The apparatus of claim 14 wherein each groove circumscribes the roller substantially transversely relative to the longitudinal axis of the roller.

19. The apparatus of claim 14 wherein the spaced apart relationship is provided by a groove which extends along a portion of the longitudinal length of one of the rollers of the second pressurized roller system.

20. The apparatus of claim 14 wherein the spaced apart relationship is provided by idler bearings and spacer rings which circumscribe each end of a roller of the second pressurized roller system.

21. The apparatus of claim 14 wherein the spaced apart relationship is a distance from about 0.002 to about 0.020 inch.

22. The apparatus of claim 20 wherein the rollers forming the second pressurized roller system are rotated at differing speeds during use thereof.

23. The apparatus of claim 14 wherein the spaced apart relationship is provided by idler bearings and spacer rings which circumscribe each end of a roller of the second pressurized roller system.

24. The apparatus of claim 23 wherein the rollers forming the first pressurized roller system are rotated at differing speeds during use thereof.

25. The apparatus of claim 14 wherein one roller is common to each of the first pressurized roller system and the second pressurized roller system.

26. The apparatus of claim 14 which provides sheet-like reclaimed tobacco material which is about 2 inches in width.

27. A process for providing reclaimed tobacco material in sheet-like form, said process comprising the steps in combination (a) providing tobacco material including tobacco leaf stem material, the tobacco material having a moisture content less than about 30 weight percent, and then (b) passing the tobacco material through the nip of a pressurized roller system having two rollers exhibiting a nip zone pressure sufficient to provide compression of said tobacco material thereby providing said sheet-like material, wherein (i) at least one of the roller faces comprises a series of grooves, which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the tobacco leaf material is employed in a structural strength providing amount and (ii) wherein the roller faces of the rollers are in a spaced apart relationship in the region along the rollers where the reclaimed tobacco material is formed and wherein the spaced apart relationship between the faces of the rollers provides a sufficient distance therebetween to provide formed sheet-like reclaimed tobacco material.

28. The process claim 27 wherein said of tobacco material is provided in the absence of a binder.

29. The process of claim 27 wherein the amount of said tobacco leaf stem material in said tobacco material is at least about 15 percent, based on the total weight of said tobacco material.

30. The process of claim 27 wherein each of said nip zone pressures is at least about 3,000 pounds per linear inch.

31. The process of claim 27 wherein the tobacco material exhibits a moisture content between about 15 weight percent and about 18 weight percent.

32. The process of claim 27 wherein the tobacco material exhibits a moisture content between about 14 weight percent and about 25 weight percent.

33. The process of claim 27 wherein the amount of said structural strength providing amount of leaf stem material ranges from about 15 to about 18 percent based on the total weight of tobacco material which is employed.

34. The process of claim 27 wherein each of said grooves is generally "V" shaped.

35. The process of claim 27 wherein each of said grooves circumscribe the roller substantially transversely relative to the longitudinal axis of the roller.

36. An apparatus for providing reclaimed tobacco, the apparatus comprising (a) a pressurized roller system wherein at least one of the roller faces comprises a series of grooves, which series extends longitudinally along the roller and each groove extends about the periphery of the roller, wherein each groove has a maximum width near the surface of the roller and a minimum width near the bottom of the groove, wherein each of the grooves has a maximum width and depth which is smaller than the length and/or diameter of tobacco leaf stem material, and wherein the roller faces of the rollers are in a spaced apart relationship in a region along the rollers where the reclaimed tobacco material is formed and wherein the spaced apart relationship between the faces of the rollers is a distance which approximates the thickness of sheet-like reclaimed tobacco material.

37. The apparatus of claim 36 wherein each groove has a depth which ranges from about 0.015 inch to about 0.035 inch.

38. The apparatus of claim 36 wherein each groove has a greatest width which ranges from about 0.015 inch to about 0.040 inch.

39. The apparatus of claim 36 wherein each groove circumscribes the roller substantially transversely relative to the longitudinal axis of the roller.

40. The apparatus of claim 36 wherein the spaced apart relationship is provided by a groove which extends along a portion of the longitudinal length of one of the rollers of the pressurized roller system.

41. The apparatus of claim 36 wherein the spaced apart relationship is provided by idler bearings and spacer rings which circumscribe each end of a roller of the pressurized roller system.

42. The apparatus of claim 41 wherein one of the rollers has a substantially smooth surface.

* * * * *

UNITED STATES PATENT AND TRADEMARK OFFICE

CERTIFICATE OF CORRECTION

PATENT NO. : 4,787,402

DATED : November 29, 1988

INVENTOR(S) : Gerard E. Leonard

It is certified that error appears in the above—identified patent and that said Letters Patent is hereby corrected as shown below:

On the title page, item [57], ABSTRACT,

Please insert the following at the beginning of the Abstract:

--A process for reclaiming tobacco comprises providing tobacco material including relatively large fibrous forming tobacco leaf stem material, passing the tobacco through a pressurized roller system, and forming a reclaimed tobacco material under pressure. Tobacco stems, fines, dust and waste can be reconstituted in sheet-like form using a process which utilizes relatively low amounts of moisture.--

Column 19, line 23, after "leaf" please insert --stem--.

Signed and Sealed this

Twenty-eighth Day of November 1989

*Attest:*

JEFFREY M. SAMUELS

*Attesting Officer* *Acting Commissioner of Patents and Trademarks*